US007181872B2

(12) United States Patent
Damrath et al.

(10) Patent No.: US 7,181,872 B2
(45) Date of Patent: Feb. 27, 2007

(54) FASTENING DEVICE FOR FASTENING THE CUFF OF AN ITEM OF CLOTHING ON A DEVICE FOR PRESSING THE ITEM OF CLOTHING AND FASTENING METHOD

(75) Inventors: Joachim Damrath, Bachhagel (DE); Klaus Grunert, Berlin (DE); Axel Michelmann, Gross-Gerau (DE); Peter Nober, Rommersheim (DE); Markus Spielmannleitner, Ellwangen (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/978,193

(22) Filed: Oct. 29, 2004

(65) Prior Publication Data

US 2005/0278985 A1 Dec. 22, 2005

(30) Foreign Application Priority Data

Oct. 29, 2003 (DE) ..... 103 50 496

(51) Int. Cl.
*D06F 71/28* (2006.01)
*D06C 15/00* (2006.01)

(52) U.S. Cl. ..... 38/69; 223/72

(58) Field of Classification Search ..... 38/12, 38/13, 64; 223/52.1, 52.5, 52.6, 72, 73, 74, 223/57, 69, 67, 68, 70, 71
See application file for complete search history.

(56) References Cited

U.S. PATENT DOCUMENTS

| | | | | | |
|---|---|---|---|---|---|
| 1,980,845 | A | * | 11/1934 | Beattie | 223/52.1 |
| 2,059,295 | A | * | 11/1936 | Wilhelm | 38/13 |
| 2,375,947 | A | * | 5/1945 | Robbel | 223/57 |
| 2,417,838 | A | * | 3/1947 | Paris | 223/67 |
| 2,504,014 | A | * | 4/1950 | Forse | 223/52.1 |
| 2,685,990 | A | * | 8/1954 | Glover, Jr. | 223/73 |
| 2,729,370 | A | * | 1/1956 | Maxwell et al. | 223/73 |
| 2,743,853 | A | * | 5/1956 | McLagan | 223/57 |
| 3,151,860 | A | * | 10/1964 | Dosal | 269/43 |
| 3,184,127 | A | * | 5/1965 | Smith | 223/67 |
| 5,758,437 | A | * | 6/1998 | Tamamoto | 38/12 |
| 6,389,716 | B1 | * | 5/2002 | Riebeling et al. | 38/12 |
| 2004/0049954 | A1 | | 3/2004 | Damrath et al. | |

FOREIGN PATENT DOCUMENTS

DE 100 64 321 A1 7/2002

* cited by examiner

*Primary Examiner*—Ismael Izaguirre
(74) *Attorney, Agent, or Firm*—Craig J. Loest; Russell W. Wamock

(57) ABSTRACT

A fastening device for fastening the cuff of an item of clothing on a device for pressing the item of clothing includes a base plate and a swing-action mechanism. The swing-action mechanism is fastened on the base plate and its pivot pin runs parallel to the ends of the cuff that is to be clamped in.

18 Claims, 3 Drawing Sheets

FASTENING DEVICE FOR FASTENING THE CUFF OF AN ITEM OF CLOTHING ON A DEVICE FOR PRESSING THE ITEM OF CLOTHING AND FASTENING METHOD

BACKGROUND OF THE INVENTION

FIELD OF THE INVENTION

The present invention relates to a fastening device for fastening the cuff of an item of clothing on a device for pressing the item of clothing. The invention also relates to a method of fastening the cuff of an item of clothing on a device for pressing the item of clothing.

It is known, for the purpose of drying and pressing items of clothing, for the latter to be opened out from the inside using an inflatable body to remove creases in the item of clothing and to dry it. It is advantageous, here, if the item of clothing is tensioned in its own shape and without any creasing. Such tensioning can be achieved, in particular, by the inflatable body having the same shape as the item of clothing that is to be pressed. For such a purpose, in the case of shirt-like items of clothing, use is made of a shirt-like inflatable body, or of an inflatable body in the form of the upper part of the human body. This inflatable body has a trunk section and two sleeve sections connected laterally thereto. Such an inflatable body can be used to press all items of clothing that are intended for the upper part of the body. These may be, in particular, shirts, blouses, and jackets.

Cuffs are usually provided at the ends of sleeves of items of clothing. Buttons can usually fasten these cuffs. To avoid the end of the sleeve from sliding up on the inflatable body during the pressing operation, the end of the sleeve is connected to the inflatable body.

German Published, Non-Prosecuted Patent Application DE 100 64 321 A1, corresponding to United States Patent Publication No. 2004/0049954 A1 to Damrath et al., has proposed a device for pressing items of clothing that has an inflatable body with a flexible enclosure, the enclosure having at least one stiffening. Provided, in one embodiment, at one longitudinal end of the stiffening is a clamp that can engage around the cuff of an item of clothing that is to be opened out, in particular, of a shirt.

The disadvantage of this device is that the cuff has to be closed, i.e., buttoned up, before being clamped in. The layers of material of the item of clothing are intended to be dried and pressed by air or steam that passes through out of the inflatable body, i.e., through the enclosure of the same. The number of layers of material is doubled in the button-fastening region when a cuff is buttoned up. As a result, the number of layers of material that are to be dried and pressed by the air stream that passes out of the inflatable body is doubled. Furthermore, impressions on the bottom layers of material are caused by the layers of material located thereabove, and the pressing result is, thus, affected adversely. If the cuff is clamped into the clamp in the open, i.e., unbuttoned state, then the user of the device has to ensure that the two cuff ends are aligned precisely to avoid twisting of the sleeves of the shirt. In particular, in the case of the flap that engages around the cuff from the longitudinal end of the sleeve, however, this is difficult because the clamp blocks the view of the cuff ends and, thus, of the alignment thereof.

SUMMARY OF THE INVENTION

It is accordingly an object of the invention to provide a fastening device for fastening the cuff of an item of clothing on a device for pressing the item of clothing and fastening method that overcome the hereinafore-mentioned disadvantages of the heretofore-known devices of this general type and in the which the cuffs can be easily and precisely positioned and fixed by the user and where the fastening device to allow the shirt to be pressed without twisting.

With the foregoing and other objects in view, there is provided, in accordance with the invention, fastening device for fastening a cuff of an item of clothing on a device for pressing the item of clothing, including a base plate and a swing-action mechanism fastened on the base plate and having a pivot pin running in a direction parallel to ends of the cuff that is to be clamped therein.

The invention is based upon the fastening device having access to the ends of the cuff from the cuff opening formed between the same.

According to the invention, a fastening device for fastening the cuff of an item of clothing on a device for pressing the item of clothing has a base plate and a swing-action mechanism. The swing-action mechanism is fastened on the base plate and its pivot pin runs parallel to the ends of the cuff that is to be clamped in and/or its pivot pin running parallel to the cuff slit.

The base plate is that part of the fastening device on which is fastened the swing-action mechanism of the device; rather than being planar, it usually has a curvature corresponding to the radius of the sleeve of the shirt that is to be pressed. The pressing device, preferably, constitutes an inflatable body, and that part of the device for pressing the item of clothing on which the fastening device is provided is the sleeve section of the inflatable body. The end of the cuff, in the context of the present invention, is constituted by the ends of the cuff in the circumferential direction of the sleeve. These are the ends, in the vicinity of which, the button and the buttonhole are provided. Formed between these two ends is the cuff opening, which, as the sleeve continues, can merge into the cuff slit. According to the invention, the pivot pin of the swing-action mechanism is, thus, located in the direction of the length of the fastening device, in particular, in the direction of the length of the sleeve section of a device for pressing an item of clothing, and, thus, in the direction of the length of the sleeve of an item of clothing that is to be pressed.

The fastening device according to the invention makes it possible to fasten the cuff on the device for pressing the item of clothing by virtue of the cuff ends being fixed from the cuff opening. This makes it possible to fix the individual ends separately and, thus, to avoid impressions of one cuff end on the other. In addition, in the case of the fastening device according to the invention, it is possible for the user to make a visual check of the alignment of the longitudinal ends of the sleeve in relation to one another.

In accordance with another feature of the invention, the fastening device has two flaps, and the two flaps have a common pivot pin. The two flaps, here, are located on the opposite sides of the pivot pin. The two flaps can clamp the two ends of the cuff in. The common pivot pin is advantageous because it is, thus, possible to minimize the spacing that arises between the cuff ends in the clamped-in state.

In accordance with a further feature of the invention, there is provided a spring element, preferably, located in the pivot pin, the spring force of the spring element retaining the flaps in the closed state. The spring, which is, preferably, associated with both flaps, can, thus, ensure reliable fixing of the cuff on the inflatable body. In addition, the outlay is low as a result of the spring being used by both flaps together.

In accordance with an added feature of the invention, there is provided an operating lever on each of the flaps, and the operating lever extends from the respective flap, beyond the pivot pin. The operating lever makes it possible for the user to overcome the spring force, and to open the corresponding flap, by pressing the operating lever down. It is, thus, possible to avoid reaching into the clamping region of the flap for the purpose of opening the flap, and to simplify the operation of opening out the item of clothing.

In accordance with an additional feature of the invention, the flaps have an elastic layer on the underside. This layer makes it possible to avoid pressure marks at the cuff ends that are clamped into the flaps. In addition, the clamping action can also be improved by the elastic layer. The elastic layer may be, for example, a foam or of rubber.

In accordance with yet another feature of the invention, the base plate is, preferably, part of a stiffening part for reinforcing the cuff region of the device for pressing the item of clothing. This simplifies the construction of the pressing device as a whole. The stiffening part is, for example, a part that is provided for reinforcing the inflatable body in the region of the cuff slit. The fastening device may be fitted at the longitudinal end of such a stiffening part, which may also be referred to as a slit tongue. It is, thus, possible for a single device, in addition to fastening the item of clothing on the inflatable body, also to align the slit tongue with the cuff slit and to avoid opening of the cuff slit.

In accordance with yet a further feature of the invention, the spring element of the swing-action mechanism is, preferably, a torsion spring. This type of spring allows the two flaps to be closed reliably, although the flaps can, nevertheless, be opened separately from one another. The spring may be configured as a helical spring.

Provided on the fastening device, in one embodiment, are two connections through which the fastening device can be fastened on the device for pressing the item of clothing. These connections may be configured, for example, in the form of snap fasteners.

With the objects of the invention in view, there is also provided a fastening device for fastening a cuff of an item of clothing on a device for pressing the item of clothing, including a base plate and a swing-action mechanism fastened on the base plate and defining a direction parallel to ends of the cuff that is to be clamped therein and having a pivot pin running in the direction, flaps having at least one open state and a closed state, a spring element operatively connected to the pivot pin and having a spring force retaining the flaps in the closed state, and the pivot pin being disposed between the flaps and being common to the flaps.

In accordance with yet an added feature of the invention, each of the flaps has an underside and an elastic layer disposed on the underside.

In accordance with yet an additional feature of the invention, there is provided a stiffening part for reinforcing a cuff region of the device for pressing the item of clothing, the base plate being a part of the stiffening part.

With the objects of the invention in view, there is also provided a method of fastening the cuff of an item of clothing on a device for pressing the item of clothing, including the steps of providing a base plate, fastening a swing-action mechanism on the base plate, disposing a pivot pin on the mechanism in a direction approximately parallel to ends of the cuff that is to be clamped in the mechanism, and applying at least a part of the mechanism to the clothing item at least when pressing the item of clothing with the pressing device.

With the objects of the invention in view, there is also provided a method of fastening the cuff of an item of clothing on a device for pressing the item of clothing, including the steps of providing a base plate, fastening a swing-action mechanism on the base plate, the mechanism having flaps with at least one open state and a closed state, a spring element operatively connected to the pivot pin and having a spring force retaining the flaps in the closed state, and a pivot pin disposed in a direction approximately parallel to ends of the cuff that is to be clamped in the mechanism and disposed between the flaps and being common to the flaps, and applying at least a part of the mechanism to the clothing item at least when pressing the item of clothing with the pressing device.

In accordance with a concomitant mode of the invention, a method of fastening the cuff of an item of clothing on a device for pressing the item of clothing makes use of a device according to the invention for the purpose of fastening the cuff.

The features and advantages that have been described in relation to the fastening device also apply correspondingly—where applicable—to the method and vice-versa.

Other features that are considered as characteristic for the invention are set forth in the appended claims.

Although the invention is illustrated and described herein as embodied in a fastening device for fastening the cuff of an item of clothing on a device for pressing the item of clothing and fastening method, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
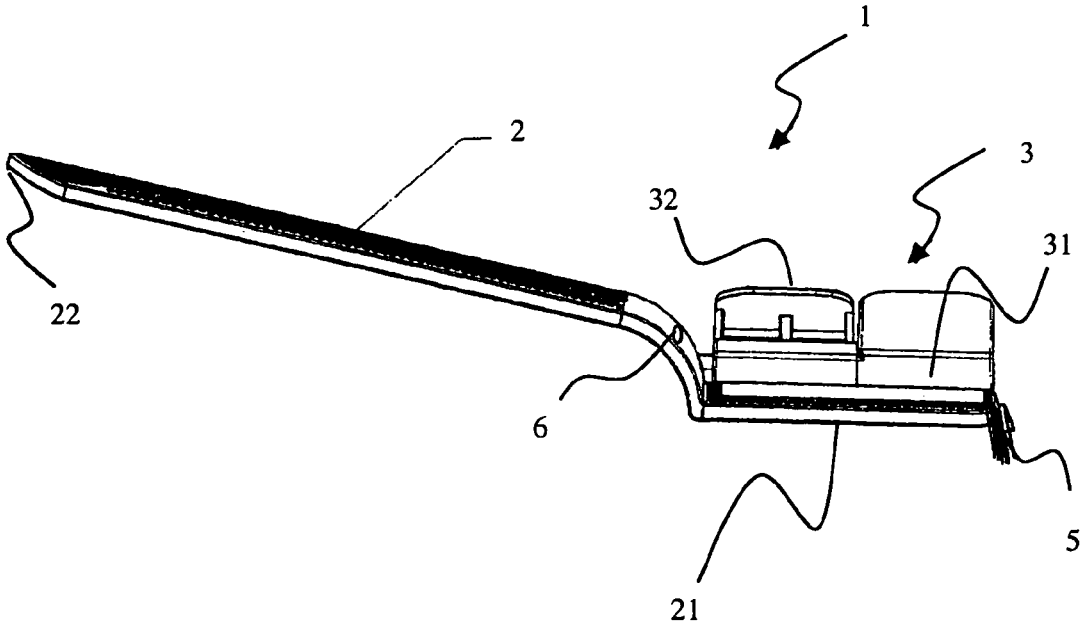
FIG. 1 is a side elevational view of an embodiment of a fastening device according to the invention.
Figure 2:
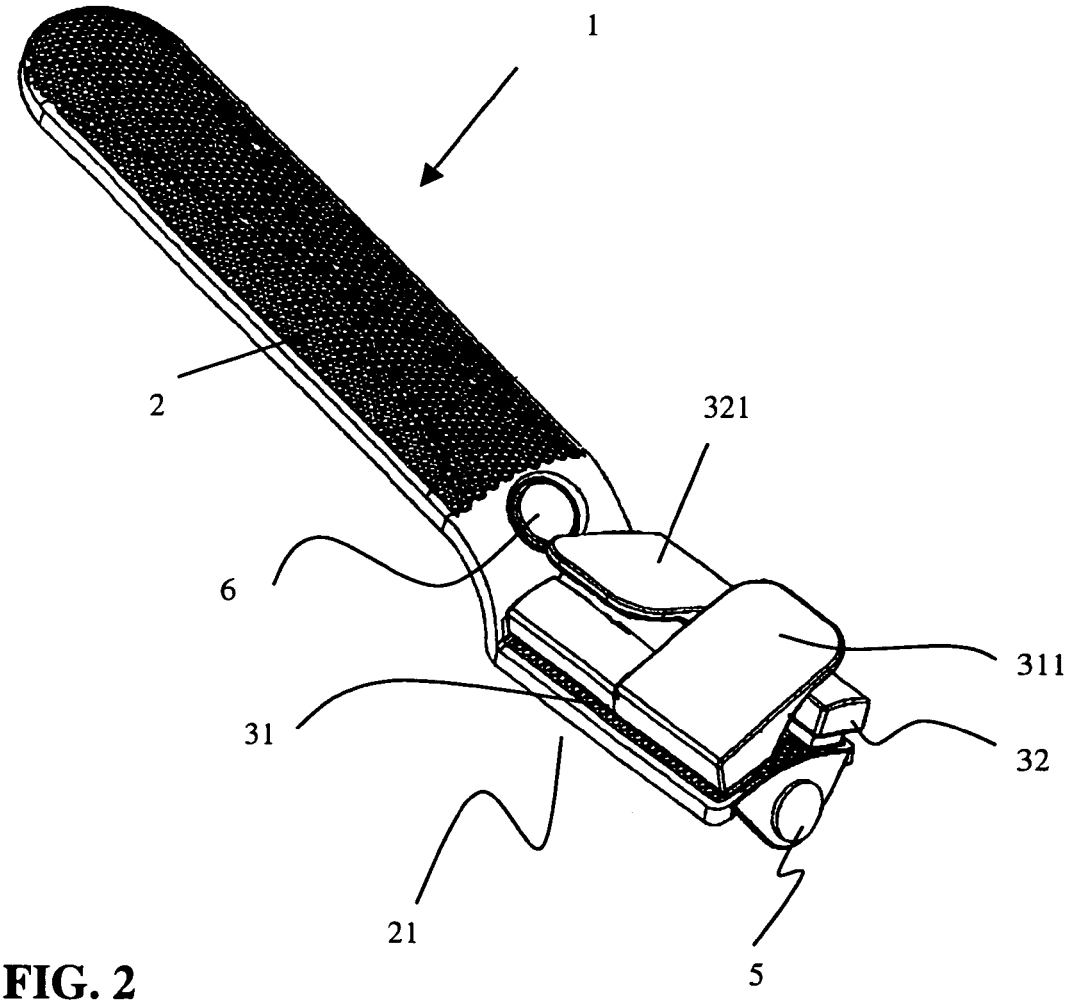
FIG. 2 is a perspective view of the fastening device of FIG. 1.
Figure 3:
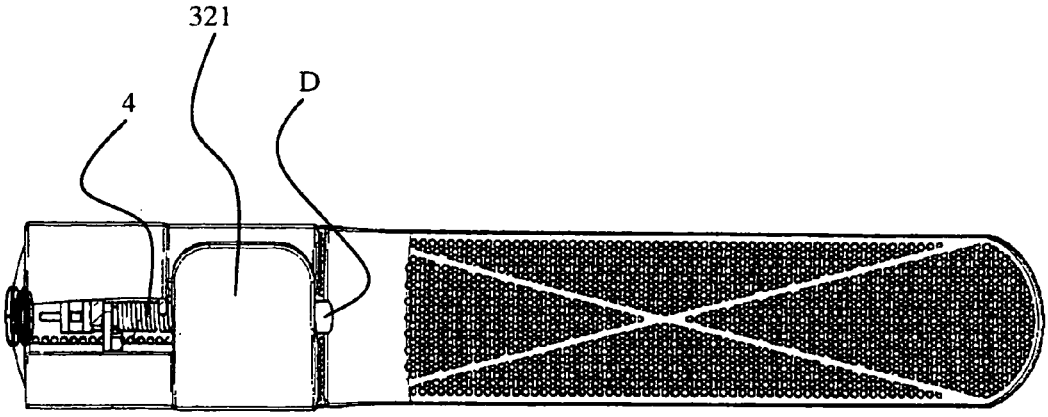
FIG. 3 is a plan view of the fastening device of FIG. 1.

Referring now to the figures of the drawings in detail and first, particularly to FIG. 1 thereof, there is shown an embodiment of a fastening device 1 according to the invention that is fitted on a stiffening part 2. The fastening region 21 of the stiffening part 2, in this embodiment, functions as a base plate 21 for the swing-action mechanism 3 of the fastening device 1. Also provided on the stiffening part 2 is a slit region 22, which serves to prevent from opening a cuff slit of a shirt that is to be pressed. The stiffening part 2 can be fitted on the sleeve section of a non-illustrated inflatable body through connections 5 and 6.

As can be gathered from FIGS. 1 to 4, the fastening device 1, in addition to the base plate 21, includes a swing-action mechanism 3. In the embodiment illustrated, the swing-action mechanism 3 has two flaps 31 and 32 that are disposed one beside the other on the base plate 21. The pivot pin D of the swing-action mechanism 3 is located between the flaps 31, 32. Located on this pivot pin is a helical spring 4, which is disposed such that its spring force presses the two flaps 31, 32 onto the base plate 21.

An elastic layer 33 is fitted on the underside of each of the flaps 31 and 32. See FIG. 4.

The flaps 31 and 32 extend over the entire length of the base plate 21 and parallel to the pivot pin D. Operating levers 311 and 321 are provided on the top side of the flaps 31 and 32. In the embodiment illustrated, these operating levers are constructed as lugs, each of the lugs extending over half the length of the respective flap 31, 32. The lugs 311 and 321 each extend at an angle from the flap 31 and 32, beyond the pivot pin D. It is, thus, possible to provide a sufficient lever arm for facilitating the tensioning of the torsion spring 4. See FIG. 3.

Figure 4:
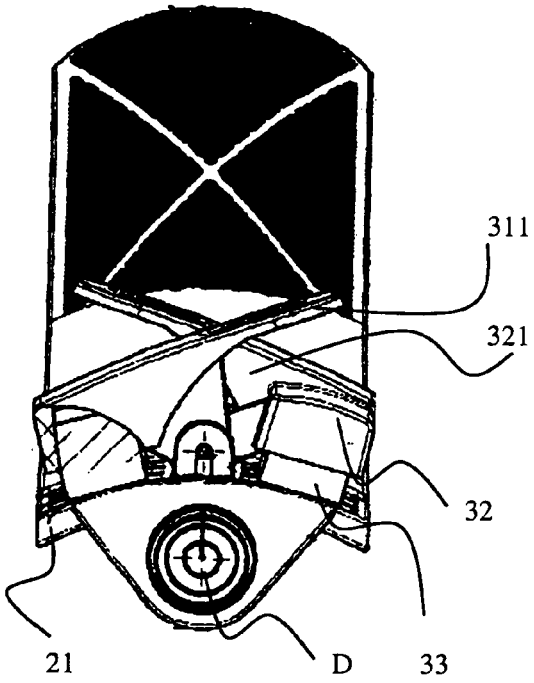
FIG. 4 is a front elevational view of the fastening device of FIG. 1.

If, in the view shown in FIG. 4, for example, the lug 321, which is connected to the flap 32, is pressed, then the flap 32 lifts off from the base plate 21 and a gap is produced, into which one cuff end can be positioned. As soon as the cuff end has been pushed in until it strikes against the spring 4, or a stop in front of the latter, the lug 321 can be released. The flap 32 is lowered on account of the spring force and encloses the cuff end between the elastic layer 33 and the base plate 21. The other cuff end can, then, be moved beneath the flap 32 in the same way, by first pressing down the lug 311.

The present invention is not restricted to the embodiment illustrated.

The operating levers may have lugs in forms other than that illustrated. The only significant factor is for the length of the operating levers to extend beyond the pivot pin of the swing-action mechanism to allow the flap to be raised.

It is also possible to use leaf springs as the spring element that retains the flaps in the closed position. Furthermore, the number of spring elements is not limited to one. It is possible to provide, for example, a dedicated spring element for each flap. It is also the case that the number of flaps is not limited to two. However, the number of flaps should be kept low to allow straightforward introduction of the cuff ends into the clamping region of the flap, i.e., between the flap and the base plate.

The fastening device according to the invention makes it possible for the cuff of an item of clothing that is to be pressed to be easily clamped in in a reliable manner and connected to the inflatable body of a device for pressing items of clothing. Furthermore, the device according to the invention can be used to clamp in the cuff of an item of clothing such that it is possible to avoid twisting in the region of the cuff and of the sleeve and also impressions on the cuff.

This application claims the priority, under 35 U.S.C. § 119, of German patent application No. 103 50 496.6, filed Oct. 29, 2003; the entire disclosure of the prior application is herewith incorporated by reference.

We claim:

1. A fastening device for fastening a cuff of an item of clothing on a device for pressing the item of clothing, comprising:

a base plate; and a swing-action mechanism fastened on said base plate and having a pivot pin running in a direction parallel to a stiffening part extending and supporting a longitudinal length of a cuff slit of the cuff that is to be clamped therein.

2. The fastening device according to claim 1, wherein said mechanism has two flaps and said pivot pin is disposed between said flaps and is common to said flaps.

3. The fastening device according to claim 2, further comprising a spring element at said pivot pin having a spring force retaining said flaps of said mechanism in a closed state thereof.

4. The fastening device according to claim 3, wherein said spring element is associated with said flaps together.

5. The fastening device according to claim 3, wherein said spring element is associated with said two flaps together.

6. The fastening device according to claim 3, wherein said spring element is associated with both of said two flaps.

7. The fastening device according to claim 2, wherein each of said flaps has an operating lever extending from a respective one of said flaps beyond said pivot pin.

8. The fastening device according to claim 2, wherein each of said flaps has an underside and an elastic layer disposed on said underside.

9. The fastening device according to claim 1, wherein said base plate is a stiffening part for reinforcing a cuff region of the device for pressing the item of clothing.

10. The fastening device according to claim 1, further comprising a stiffening part for reinforcing a cuff region of the device for pressing the item of clothing, said base plate being a part of said stiffening part.

11. The fastening device according to claim 3, wherein said spring element is a torsion spring.

12. The fastening device according to claim 1, further comprising two connections associated with at least one of said base plate and said mechanism and through which said at least one of said base plate and said mechanism is to be fastened on the device for pressing the item of clothing.

13. A fastening device for fastening a cuff of an item of clothing on a device for pressing the item of clothing, comprising:

a base plate; and a swing-action mechanism fastened on said base plate and defining a direction parallel to ends of the cuff that is to be clamped therein and having:

a pivot pin running in said direction;

flaps having at least one open state and a closed state;

a spring element operatively connected to said pivot pin and having a spring force retaining said flaps in said closed state;

said pivot pin being disposed between said flaps and being common to said flaps; and said pivot pin running in a direction parallel to a stiffening part extending and supporting a longitudinal length of a cuff slit of the cuff that is to be clamped therein.

14. The fastening device according to claim 13, wherein each of said flaps has an underside and an elastic layer disposed on said underside.

15. The fastening device according to claim 13, further comprising a stiffening part for reinforcing a cuff region of the device for pressing the item of clothing, said base plate being a part of said stiffening part.

16. The fastening device according to claim 13, wherein said spring element is a torsion spring.

17. A method of fastening the cuff of an item of clothing on a device for pressing the item of clothing, which comprises:

providing a base plate;

fastening a swing-action mechanism on the base plate;

disposing a pivot pin on the mechanism in a direction approximately parallel to ends of the cuff that is to be clamped in the mechanism; and applying at least a part of the mechanism to the clothing item at least when pressing the item of clothing with the pressing device, wherein said pivot pin runs in a direction parallel to a stiffening part extending and supporting a longitudinal length of a cuff slit of the cuff that is to be clamped therein.

18. A method of fastening the cuff of an item of clothing on a device for pressing the item of clothing, which comprises:

providing a base plate;

fastening a swing-action mechanism on the base plate, the mechanism having:

flaps with at least one open state and a closed state;

a spring element operatively connected to the pivot pin and having a spring force retaining the flaps in the closed state; and a pivot pin disposed in a direction approximately parallel to ends of the cuff that is to be clamped in the mechanism and disposed between the flaps and being common to the flaps; and applying at least a part of the mechanism to the clothing item at least when pressing the item of clothing with the pressing device, wherein said pivot pin runs in a direction parallel to a stiffening part extending and supporting a longitudinal length of a cuff slit of the cuff that is to be clamped therein.

* * * * *